US005133418A

United States Patent [19]

Gibson et al.

[11] Patent Number: 5,133,418

[45] Date of Patent: Jul. 28, 1992

[54] DIRECTIONAL DRILLING SYSTEM WITH ECCENTRIC MOUNTED MOTOR AND BIAXIAL SENSOR AND METHOD

[75] Inventors: Paul N. Gibson, Saluda, S.C.; Leo J. Barbera, St. Augustine, Fla.

[73] Assignee: Lag Steering Systems, Rocky Mt., N.C.

[21] Appl. No.: 646,852

[22] Filed: Jan. 28, 1991

[51] Int. Cl.[5] ..... E21B 4/02; E21B 4/20; E21B 7/08; E21B 47/022

[52] U.S. Cl. ..... 175/45; 175/61; 175/62; 175/121; 175/162

[58] Field of Search ..... 175/57, 61, 62, 122, 175/162, 203, 195, 103, 107, 26, 45, 73, 74

[56] References Cited

U.S. PATENT DOCUMENTS

| | | | |
|---|---|---|---|
| 1,726,438 | 8/1929 | Knorr | 175/122 |
| 2,196,260 | 4/1940 | Gatto | 175/62 X |
| 2,879,033 | 3/1959 | Edwards et al. | 175/62 X |
| 2,904,310 | 9/1959 | Leonard | 175/122 X |
| 3,926,268 | 12/1975 | Coski | 175/162 X |
| 4,267,893 | 5/1981 | Mannon, Jr. | 175/65 |
| 4,629,014 | 12/1986 | Swisher et al. | 175/162 X |
| 4,739,841 | 4/1988 | Das | 175/45 X |
| 4,747,303 | 5/1988 | Fontenot | 175/45 X |
| 4,909,336 | 3/1990 | Brown et al. | 175/61 X |

*Primary Examiner*—Stephen J. Novosad

*Attorney, Agent, or Firm*—Cort Flint

[57] ABSTRACT

Apparatus and method for a directional drilling system is disclosed wherein a concrete pit is poured at a reference entry angle in the earth so that a drilling platform cartridge inserted into the concrete pit is set at the desired entry angle. A frame, including elongated guide ways extending between ends of the platform cartridge, guides a carriage that advances a drill string through the earth at the reference angle. Preferably, a drilling head at the end of the drill string and the remainder of the drill string are rotated by a drive motor carried on the carriage. A drill bit and drill bit motor are mounted coaxially and eccentric with respect to the drilling head. The center axis of the drill bit and drill bit motor, and the center axis of the rotating drilling head are offset and define a known relationship. The offset relationship between the center axis of the drill bit and drilling head defines an eccentric position in which the drill bit overcuts relative to the outside diameter of the drilling head in an eccentric position. As long as the drilling bit and drilling head rotate simultaneously, movement of the drill string is controlled generally in a straight line. If rotation of the drilling head is stopped, the drill string is steered in the direction of the eccentric position of the drill bit since there is no clearance on the opposing side of the drilling head.

81 Claims, 8 Drawing Sheets

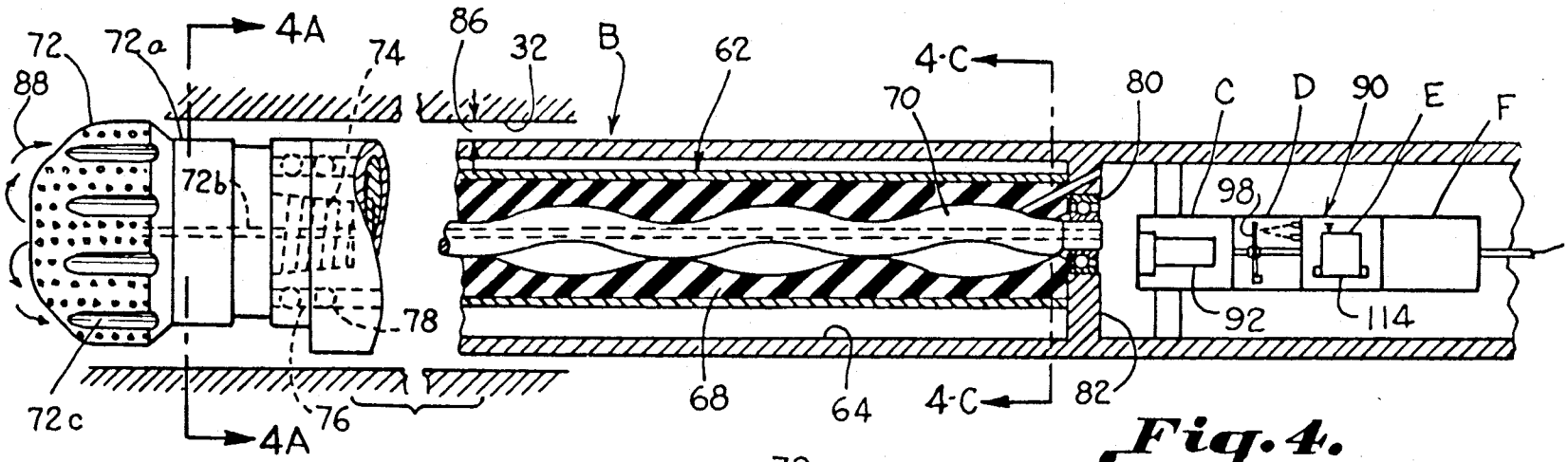
Fig. 4.
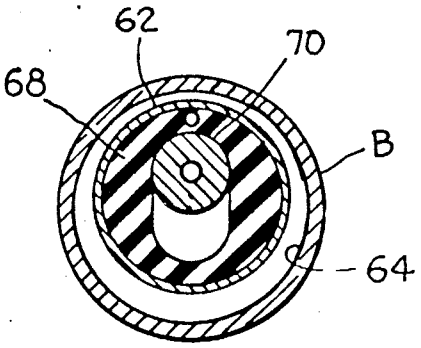
Fig. 4-C
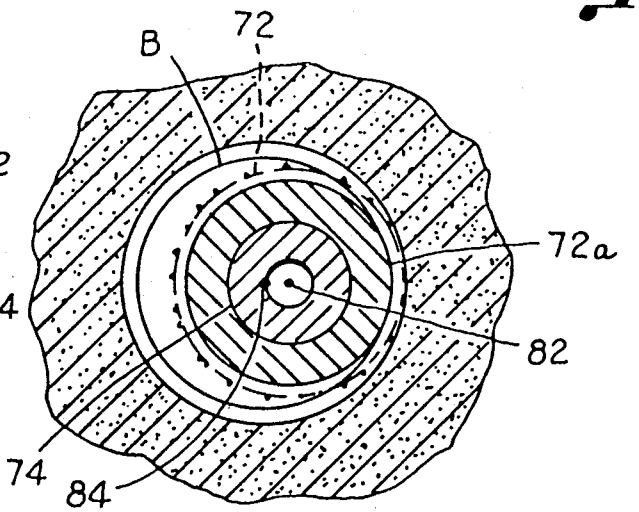
Fig. 4-B.
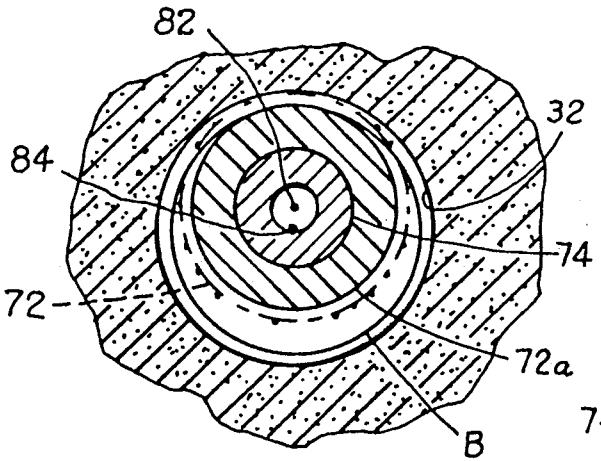
Fig. 4-A.

DIRECTIONAL DRILLING SYSTEM WITH ECCENTRIC MOUNTED MOTOR AND BIAXIAL SENSOR AND METHOD

BACKGROUND OF THE INVENTION

The invention relates to a directional drilling system for cutting a bore in the earth, and particularly to an improved drilling platform and steering and guidance system for rock drilling.

It is known in the art of drilling earth and rock bores to utilize a drill string having a drilling tool attached to its outer end with a drill bit which is rotated by a positive displacement motor. A fluid such as air, slurry, or a relatively incompressible liquid is forced down the drill string and on passing through the fluid operated motor, causes rotation of a shaft connected to the drill bit. As the drilling tool progresses away from the drilling rig, more drill pipe is added between the drill bit motor and the drilling platform. As each joint of drill pipe is added to the drill string, the fluid flow to the drill bit motor must be interrupted. Once the connection of another joint of drill pipe is completed, the fluid flow to the drilling tool is again initiated. A typical fluid driven motor is illustrated in U.S. Pat. No. 4,936,397.

Numerous methods have been proposed for steering the drill string. A most typical steering apparatus and method includes the use of a bent sub. Typical bent sub type directional drilling devices are illustrated in U.S. Pat. Nos. 4,653,598; 4,905,774; and 2,329,597. A problem with the bent sub type directional drilling devices is that the bore cut by such devices is substantially oversized since the entire elbow rotates in the bore. For example, the prior bent sub type drilling devices may cut a bore from 2 to 10 inches oversized due to the angle of the bent sub.

Another component of the typical directional drilling system is a guidance system which measures the position of the drilling tool. A typical directional drilling system uses steering tools to survey the curved and horizontal portions of the tool while drilling. These wireline tools allow continuous reading of tool-face azimuth and inclination. The azimuth reading is measured with three magnetometers and the inclination is measured with three accelerometers. U.S. Pat. No. 4,905,774 discloses a device for guiding a drilling tool through geological formations.

Other methods are known for controlling the direction of small diameter earth drilling tools by using radio detection systems which monitor the position of the tool. However, these systems and methods require an individual to physically track the tool, limiting such systems to shallow bores. Such systems are not suitable for use when boring under streams, rivers, and other obstructions.

In addition to the bent sub directing devices, U.S. Pat. No. 3,243,001 discloses a rotary well drilling tool which controls the path of the drill. Control of the direction of the tool is brought about by a change in the position between a housing and a concentric sleeve wherein the position becomes eccentric. The changing of the position of the housing and respective sleeve requires a complicated fluid system working through various arrangements of orifices, conduits, pistons, and piston rods. Other steering devices using eccentric members are shown in U.S. Pat. Nos. 4,220,213 and 4,319,649.

Accordingly, an object of the invention is to provide an improved apparatus and method for directionally drilling an earthen bore, particularly rock, in a simple and accurate manner.

Another object of the invention is to provide a steering system for actively controlling the direction of a drilling head and bit which requires only a slight overcutting and eliminates large oversized bores of the bore.

Another object of the present invention is to provide an apparatus and method for accurately guiding a directional drilling tool along a desired bore direction and path.

Another object of the present invention is to provide an apparatus and method for accurately controlling the direction of a directional drilling tool which includes a fluid motor eccentrically mounted with respect to the drilling head and requires few moving parts in the drilling head for controlling the position of the eccentric and the direction of the tool.

Another object of the invention is to provide an apparatus and method for directional drilling an earthen bore which includes a guidance system for determining the horizontal and vertical angular positions of the drilling head in a simple and reliable manner.

Another object of the present invention is to provide a guidance system for a directional drilling apparatus and method wherein a single axis angular rate sensor is utilized in a manner which yields angular positions about two orthogonal axis in a simple and reliable manner.

Another object of the present invention is to provide a simple and reliable guidance system for a directional drilling head which is non-magnetic and which is not influenced by anything except the displacement of the drilling head and which accurately measures any horizontal and vertical deviations and distance travelled by the drilling head in a simple and reliable manner.

Another object of the invention is to provide a control system for controlling the path of a directional drilling head which includes an eccentrically mounted fluid motor and rotating drill bit, an angular rate sensor, and an encoder for instantaneously indicating the eccentric position of the drill bit, and the position of the drilling head in a simple and reliable manner whereby the drill string is steered by stopping of drill string rotation at a desired eccentric position and by starting drill string rotation once deviations are eliminated.

Another object of the invention is to provide a directional drilling system having a drilling platform cartridge which may be inserted in a rock pit to provide a form about which concrete may be filled in the pit to provide a stable drilling platform.

Another object of the invention is to provide a directional drilling apparatus and method having an improved drilling frame assembly which advances the drill string through the earth while drilling a bore and by which accurate control of the drilling direction and process may be had.

Another object of the invention is to provide a control system for a directional drilling tool wherein the distance from a starting point may be determined in a simple and reliable manner using accelerometers which accurately measure distance travelled.

Another object of the present invention is to provide apparatus for directional drilling an earthen bore which includes a drill bit which cuts an eccentric pattern by continuous rotation of a drill string which results in equal clearance around the drill head resulting in a straight bore with little overcut and wherein the apparatus may be steered by stopping and starting rotation of the drill string to accurately control the direction of the drilling head and bit in a simple and reliable manner.

Another object of the invention is to provide a directional drilling system which is completely self contained and can be used at any depth and to bore under streams, rivers, and any other type of obstruction.

SUMMARY OF THE INVENTION

The above objectives are accomplished according to the invention by providing a directional drilling system of the type which includes a drill string having a plurality of drill stems joined together for drilling a bore through the earth in a prescribed direction. A drilling platform is disposed at a starting point. A frame is carried by the platform and a carriage is carried by the frame. A carriage advance moves the carriage longitudinally along the platform as drill string drive motor rotates the drill string. A drilling head is carried at an end of the drill string. A drill bit motor is carried by the drilling head. A drill bit is carried by the drill bit motor. An eccentric mount mounts the drill bit eccentrically in the drilling head to define an eccentric position in which the drill bit overcuts relative to a diameter of the drilling head. An indicator device indicates the rotational angular position of the eccentric position of the drill bit relative to the drill string. A position measuring system measures the position of the drilling head and indicates deviations in the position of the drilling head with reference to a desired drill string path according to the prescribed bore direction. Motor controls vary the relative speeds of the drill string drive motor and the drill bit motor to control the eccentric position of the drill bit to overcut in a desired direction and control the direction of the drilling head and drill string in response to the deviations in the drilling head position.

The position measuring system includes an angle sensor for measuring first and second position angles of the drilling head and generating first and second angle signals corresponding to the horizontal and vertical position angles of the drilling head. The angle sensor includes an angular rate sensor carried by the drill string for measuring changes about a first axis per unit time. The angular rate sensor is rotatably carried with the drill string to measure changes in direction about a second axis per unit time for generating first and second angular rate signals corresponding to changes directions per unit time about the first and second axes. An encoder identifies the instantaneous rotational position and timing of the angular rate sensor and the drill string as they rotate together. An electronic integrator integrates the first and second angular rates as the drilling head rotates through four encoded quadrants identified by the encoder means to compute the horizontal and vertical angular position angles. The position measuring system also includes a distance measuring device for measuring the distance the drilling head has travelled from the starting point and computes the horizontal and vertical position of the drilling head by multiplying the distance by the horizontal and vertical position angles. The encoder includes a gravity referenced encoder disk with a plurality of encoded position indicators around the periphery of the encoder disk, and a detector for converting the position indicators into the rotational position and timing of the angular rate sensor.

A method according to the invention for guiding and steering a directional drill string includes mounting an angular rate sensor in the drilling head which measures angular rate about a single axis per unit of time, rotating the single axis angular rate sensor about the central axis of the drilling head to measure angular rate about first and second sensing axes, and generating first and second angular rate signals corresponding to horizontal and vertical angular rates. The rotational position of the angular rate sensor is determined as it rotates with the drilling head through four quadrants, and quadrant position and timing signals are generated corresponding to the quadrant position and timing of the angular rate sensor as it rotates with the drilling head. The horizontal and vertical angular rate signals, and sensor quadrant position and timing signals are integrated to generate horizontal and vertical position angles of the drilling head. The distance the drilling head has travelled from a starting point is determined, and the horizontal and vertical positions determined using the position angles. The horizontal and vertical positions are compared to a desired drill path, deviations from the path are calculated; and the drilling head is steered to eliminate the deviations. Preferably, the method includes measuring the distance the drilling head has travelled by disposing an accelerometer along the central axis of the drilling head, generating a distance signal in reference to movement of the drilling head, and integrating the distance signal to provide distance travelled from a starting point. The rotational quadrant position of the angular rate sensor is measured by rotatably mounting a gravity referenced disk on a rotational axis concentric with the central axis of the drilling head, and detecting position indicators on the encoder disk with a detector which rotates with the drilling head. A method for steering the directional drilling device includes rotating the drilling head carried at an end of the drill string, and mounting a rotating drill bit eccentrically in the drilling head so that a center axis of the drill bit and drilling head have a known relationship. The drill bit has an eccentric position in which the drill bit overcuts the bore relative to a diameter of the drilling head. The relative rotational speeds of the drilling head and drill bit are controlled to alter the eccentric position of the drill bit to overcut the bore in a desired direction and control the direction of the drilling head and drill string to eliminate the deviations.

The method according to the invention further includes excavating a pit in the earth at a starting point of the drill string and placing a form in the earth pit at a prescribed inclination corresponding to a desired reference entry angle of the drilling string and drilling head. Concrete is poured in the earth pit between the form and the earth to form a concrete pit having a pit opening corresponding to the form, and the form is thereafter removed. A drilling platform having a shape generally conforming to the shape of the form is placed in the pit opening of the concrete pit so that the platform is set in the concrete pit at the reference entry angle. Finally, the method includes assembling the drilling head and drill string on the platform so that the drilling head is oriented in the direction of the reference entry angle.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 4 is a sectional view taken along line 4—4 of FIG. 1;

FIG. 4A is a sectional view taken along line 4A—4A of FIG. 4;

FIG. 4B is a sectional view taken along the same line as FIG. 4A but with the drill bit in a 90 degree rotated position for drilling to the left in accordance with the invention;

FIG. 4C is a sectional view taken along line 4C—4C of FIG. 4;

DESCRIPTION OF A PREFERRED EMBODIMENT

Figure 1:
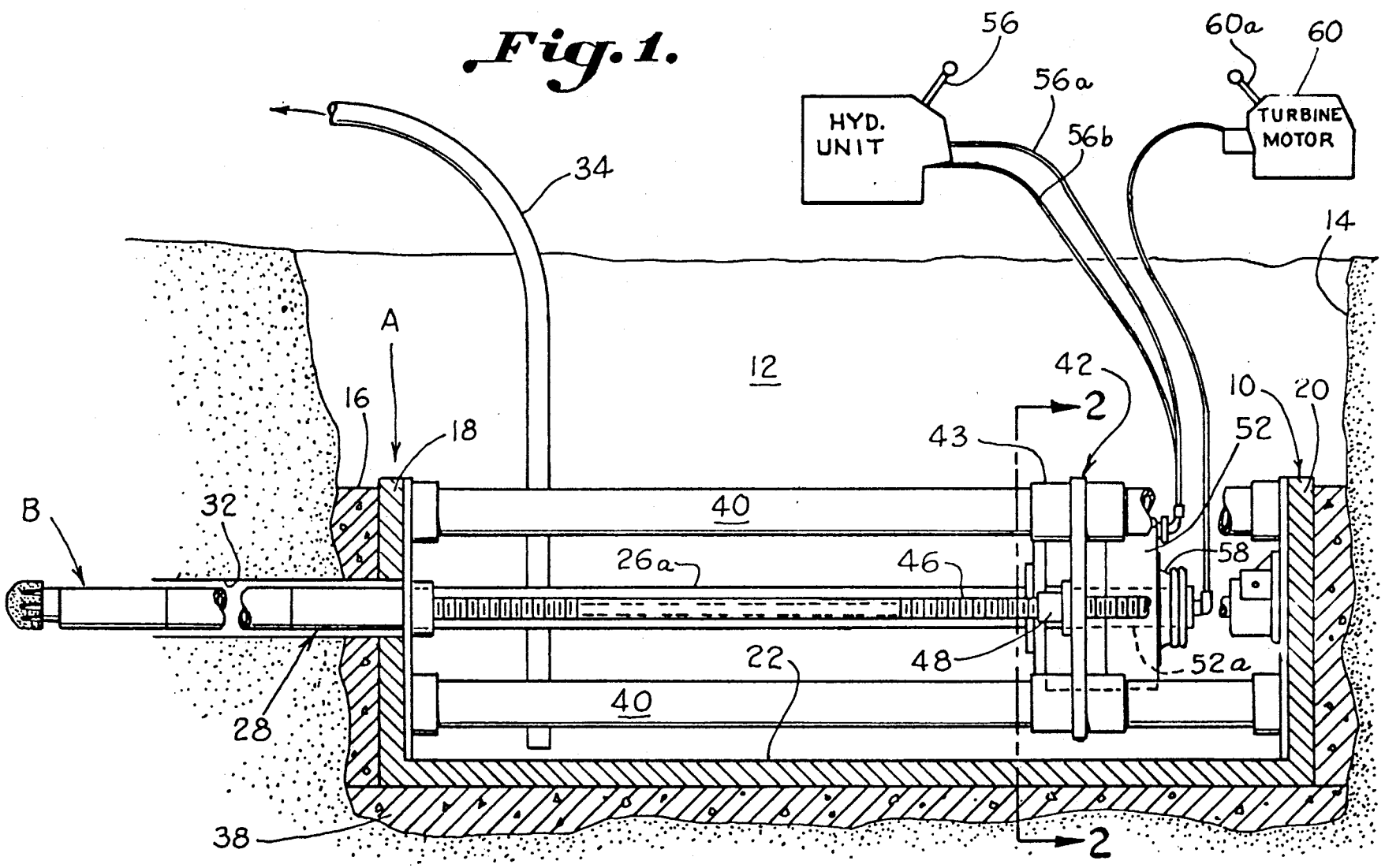
FIG. 1 is an elevation, with parts cut away, illustrating a cartridge drilling frame for controlling and advancing a drill string during the drilling of an earthen bore in accordance with the invention.
Figure 2:
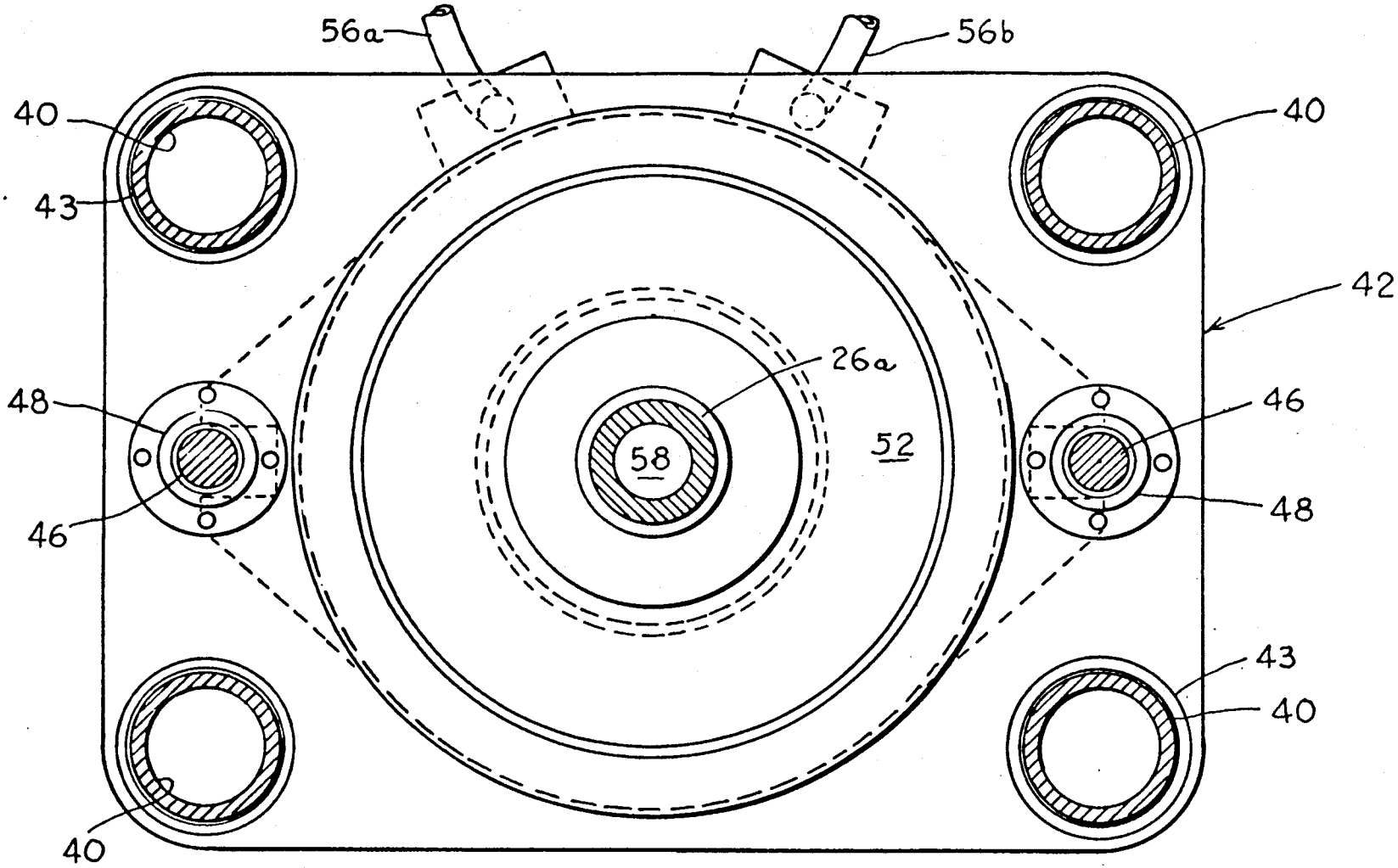
FIG. 2 is a sectional view taken along line 2—2 of FIG. 1.

Referring now in more detail to the drawings, a directional drilling apparatus and method is illustrated. As can best be seen in FIG. 1, a drilling platform cartridge assembly, designated generally as A, is illustrated which includes a drilling platform cartridge 10 inserted in a pit 12. In a preferred embodiment, walls 14 of pit 12 are excavated, a form (not shown) corresponding in shape to cartridge 10 is inserted in the pit, and then concrete 16 is poured between excavated walls 14 and the form for cartridge 10. The form is removed, and platform cartridge is inserted in concrete pit 16 as illustrated. While the invention is particularly advantageous for drilling in "rock", the term "earth" used in this application is meant to be all encompassing for all forms of earth, i.e. rock, soil, etc.

Figure 3:
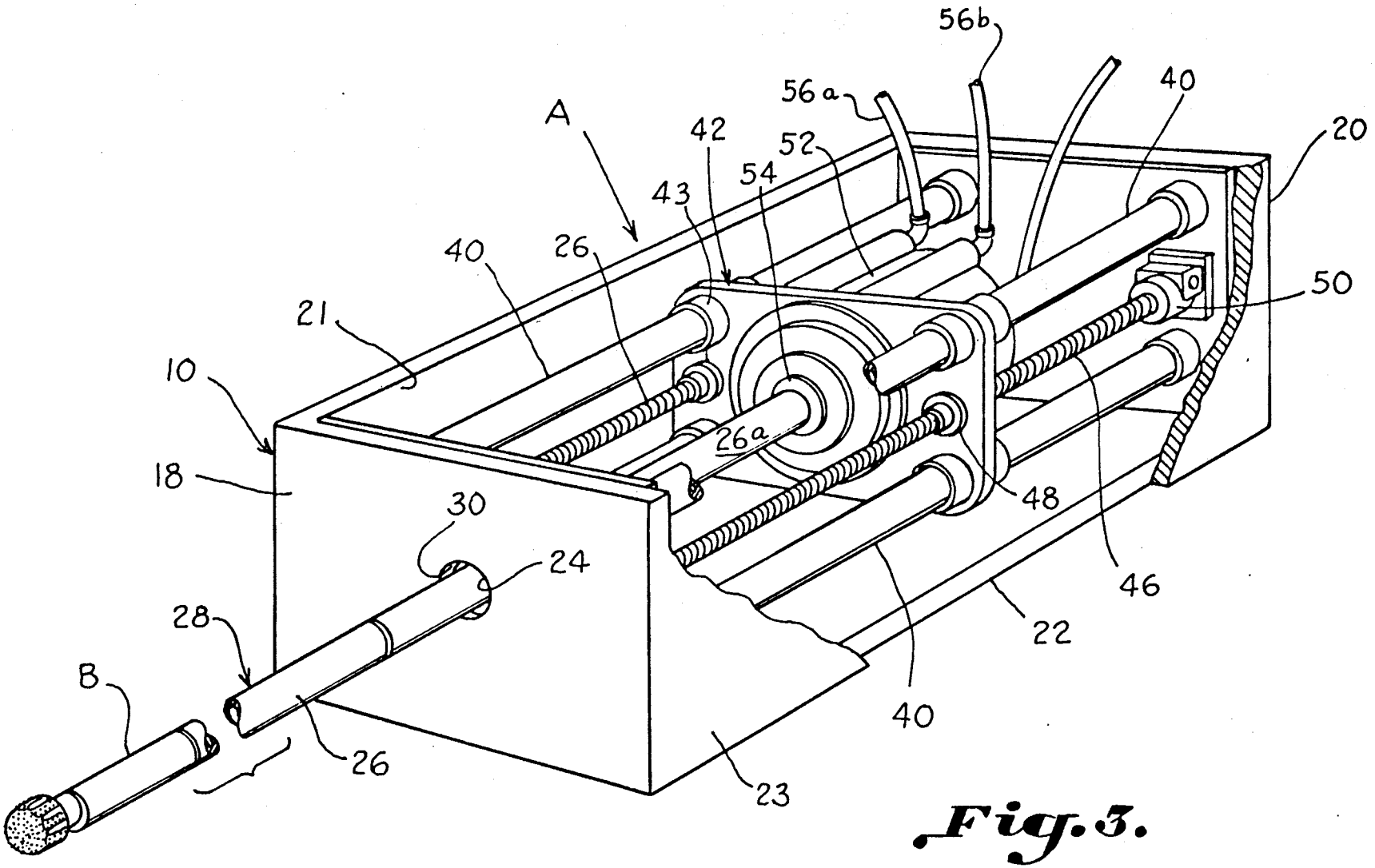
FIG. 3 is an elevation view illustrating a cartridge frame for a directional drilling system according to the invention.
Figure 5:
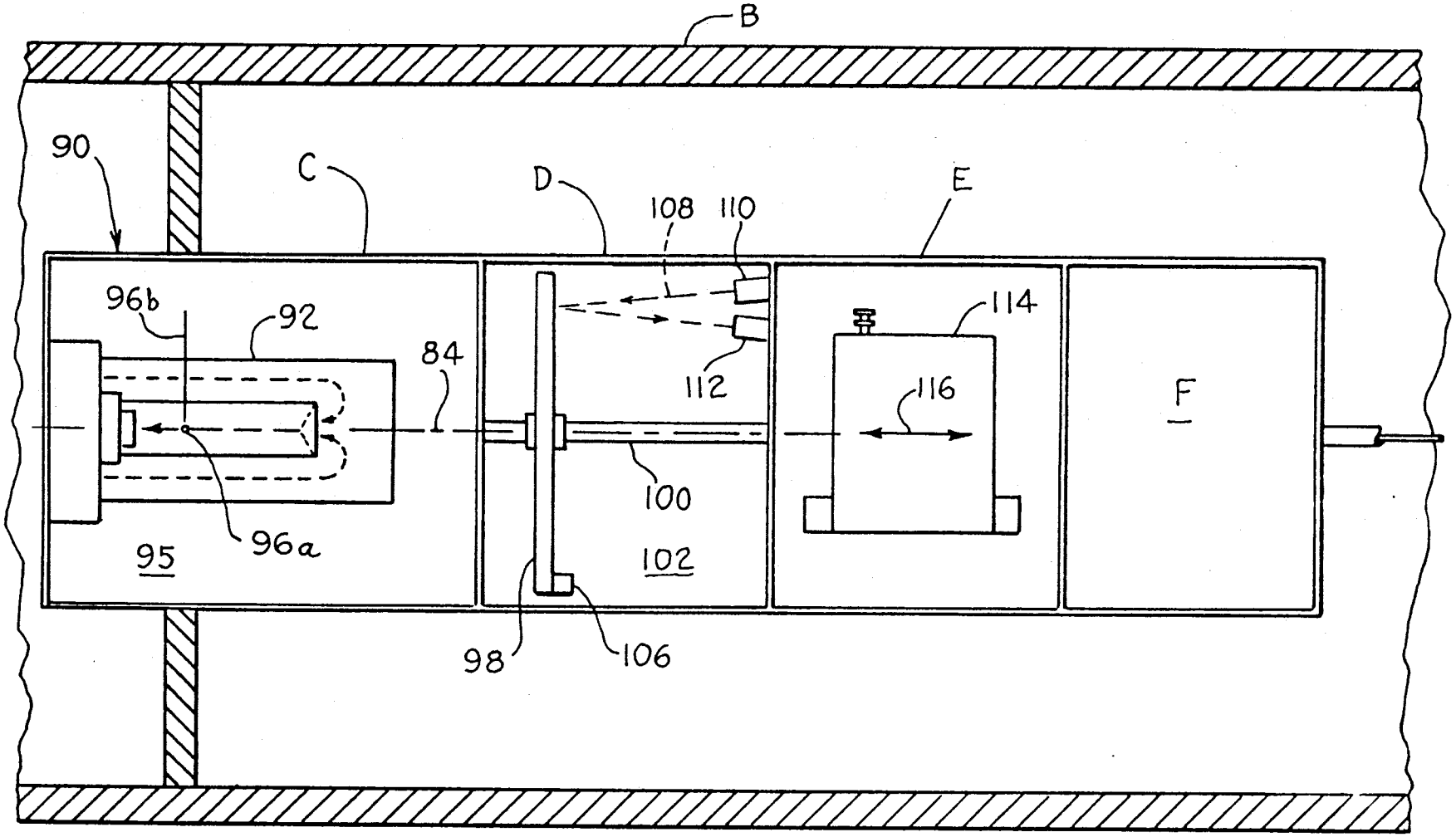
FIG. 5 is an enlarged sectional view of a guidance module constructed according to the invention.
Figure 6:
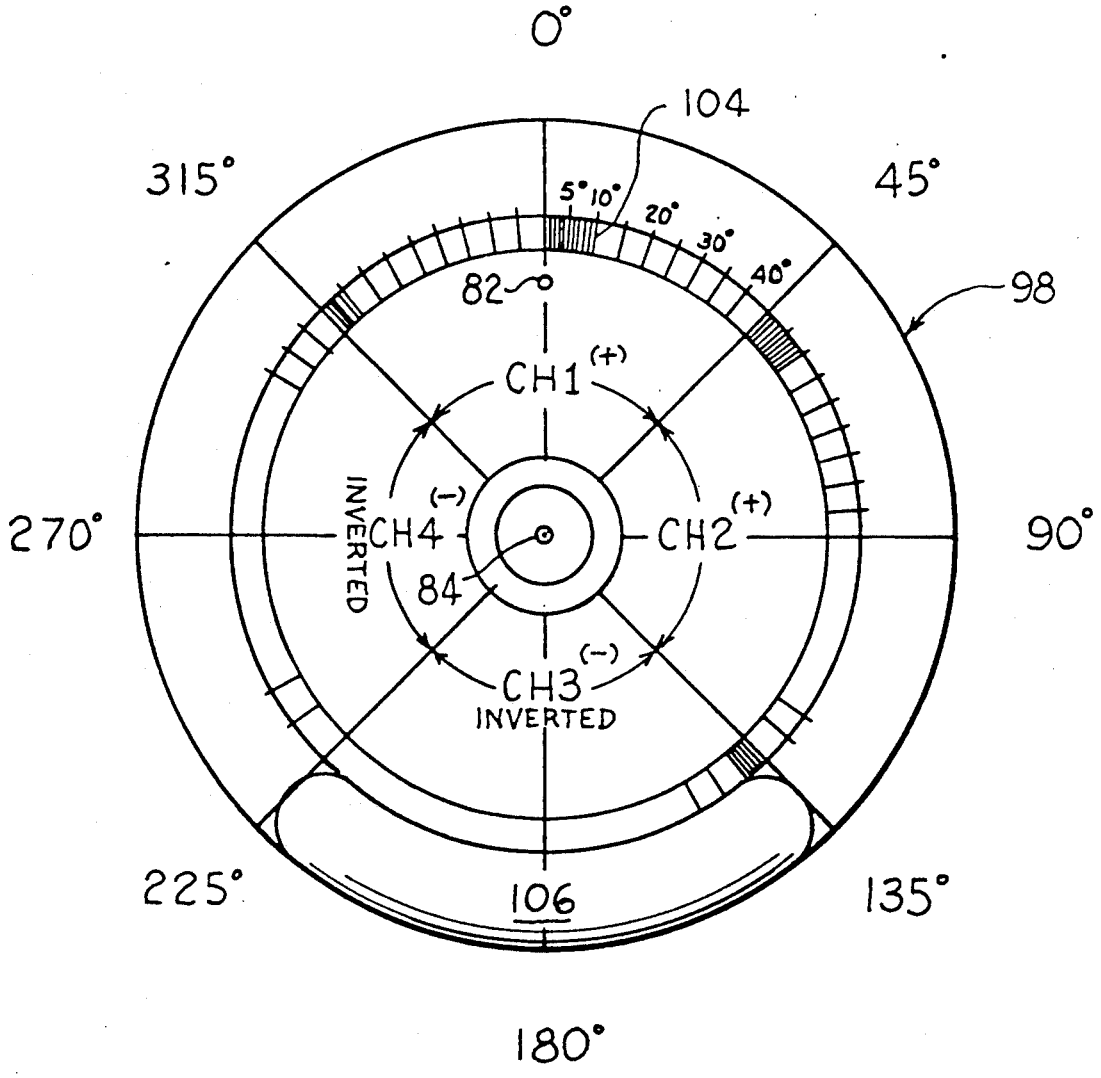
FIG. 6 is a schematic illustration of an angular encoder according to the invention.
Figure 7:
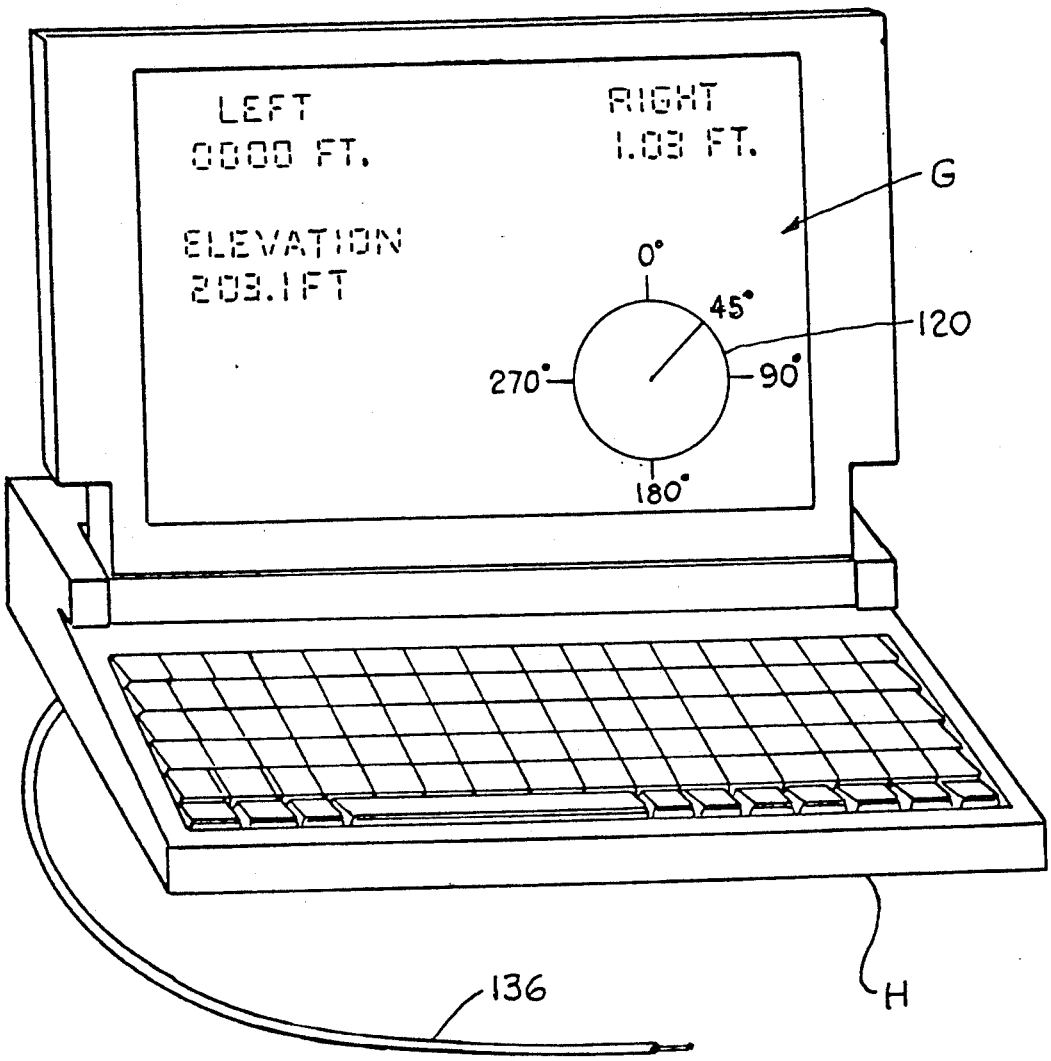
FIG. 7 is a perspective view of a computer for processing the drill bit position and angular positions of a drilling head, and distance travelled of a drilling head, according to the invention.
Figure 8:
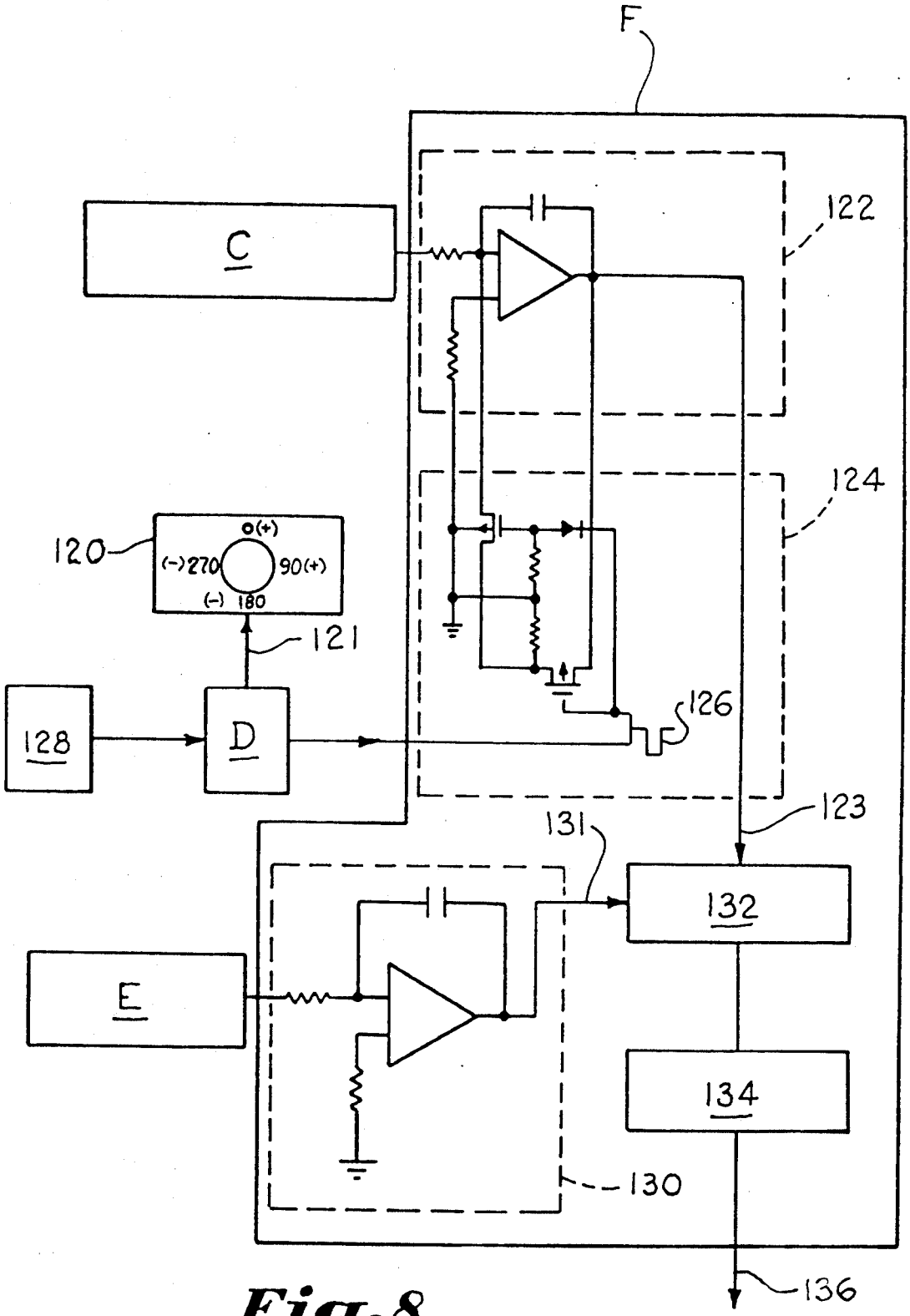
FIG. 8 is a schematic diagram of a guidance and control system for computing the position and deviations of a drill string according to the invention.

As can best be seen in FIG. 3, drilling platform 10 includes a first end wall 18 and a second end wall 20. Drilling platform 10 may be constructed from many suitable materials such as metal, concrete, or suitable reinforced structure. End walls 18 and 20 are carried by horizontal platform 22. Wall 18 includes a drill string opening 24 through which a stem 26 of a drill string, designated generally as 28, passes. There is a slurry return and exit space 30 defined between stem, 26 and the edge of opening 24 which, as illustrated, is annular. This is provided for the return of a slurry or other fluid which drives a fluid motor in the drilling head, as will be explained more fully at a later point. The slurry returns with cuttings from earthen bore 32 being drilled. An evacuation device 34 evacuates the slurry and cuttings from drill pit 12. Means for adjusting the inclination of the cartridge platform and hence the entry angle of drill string 28 is provided by placing the cartridge form in the ground at a desired entry angle. When concrete pit 16 is formed, and platform cartridge 10 inserted in its place, platform cartridge assembly A will be oriented in the desired entry direction for drill string 28. A stable drilling platform is thus provided for the drilling operation which can be controlled from above ground eliminating the inherent dangers in prior drilling rigs which have required the operator to be in the pit. Because of the stability and above ground control, the platform and pit may be reduced in size over prior art rigs and pits. For example, prior art dry drilling platforms are typically 38 feet in length, and wet drilling platforms are 24 feet in length. In accordance with the present invention, a platform cartridge having a fourteen foot length and a six foot width is advantageously used.

The frame carried by the drilling platform extends between end walls 18 and 20, and includes a plurality of guide elements 40 in the form of round tubular elements which provide a track to guide the movement of a carriage, designated generally as 42. Means for advancing carriage 42 longitudinally along the frame includes a screw drive having a pair of threaded rods 46 which are threadably received in collars 48 carried by carriage 42. Suitable motor 50 are carried by end wall 20 to rotate screw drive rods 46 and advance carriage 42 either forward or rearward in reciprocating linear motions. Other means for advantageously advancing the carriage along the platform may be utilized according to the invention. Due to the relative short length of the drilling platform, a hydraulic cylinder may be utilized. The cylinder may be attached to end wall 18, and the piston may be attached to carriage plate 42. The hydraulic cylinder advanced the carriage on the pull stroke in the forward direction, and indexes it rearward on the push stroke. This is particularly advantageous when drilling a pilot hole in the forward direction and drilling a larger hole by pulling the drill string rearward through the pilot hole with a larger drill bit. In this case, the larger pushing forces of the hydraulic cylinder are used to drill the larger bit in the rearward direction.

A drill string drive motor 52 is carried by carriage 42 which rotatable drives drill string 28. Any suitable motor may be utilized for the drive drill string motor such as a hydraulic motor manufactured by Fender Corporation of Elgin, Ill., manufactured as a Hydrex® direct drive hydraulic motor. This motor includes a coupling or chuck 54. A stem 26*a* is coupled to the hydraulic motor directly by chuck 54. Hydraulic fluid is throttled from a throttle control 56 above ground via inlet and outlet lines 56*a* and 56*b*. The hydraulic motor is operated by a radial piston which allows the motor to have a hollow shaft. The hollow shaft 52*a* of the hydraulic motor is provided with a rotary journal 58 which allows a coupling to a turbine motor control 60 having a throttle 60*a*. This control delivers a suitable motive fluid to a turbine motor designated generally as 62 contained in drilling head B, as can best be seen in FIG. 4. The motive fluid goes through hollow shaft 52*a* and through the hollow interior of stems 26 of drill string 28. In a typical manner, the drill string is rotated and pushed forward by carriage 42 as drilling head B drills the earthen bore. When carriage 42 reaches its forward extent, the hydraulic fluids are cut off, stem 26*a* is removed from coupling 54. Carriage 42 is then moved rearward to its rearward most position, a new stem section 26*a* is coupled to chuck 54 at one end and joined to the previously coupled drill stem at the opposite end.

The motor fluids are then reestablished and pushing of the drill string through the earthen bore again initiated by the advance of carriage 42. Drilling stems 26 typically come in five, ten, or fifteen foot lengths which are threaded together for joining.

As can best be seen in FIG. 4, drilling head B includes fluid turbine motor 62 eccentrically mounted within interior diameter 64 of drilling head B. Fluid turbine 62 may be any suitable fluid turbine motor, commonly referred to in directional drilling as a mud motor. A suitable mud motor is manufactured by Grifco, Inc. of Scott, La. As noted previously, throttle 60*a* controls the flow rate of fluid to motor 62. The motive fluid may be any suitable fluid such as a slurry composed of water and bentonite. The slurry passes through hydraulic motor 52, stem 26*a*, and the remaining stems 26 of drill string 28 until it reaches an inlet 66 of motor 62. A conventional mud motor typically includes a rubber stator 68 and a steel rotor 70. Fluid through inlet 66 drives rotor 70 in a conventional manner. A rotating drill bit 72 is rotatably driven by rotor 70. Drill bit 72 is mounted eccentrically with fluid motor 62 in the hollow interior 64 of the stem of drilling head B. Typically, drilling bit 72 includes a reduced neck 72*a*, and a threaded shank 74. Means for mounting drill bit 72 and drill bit motor 62 eccentrically in the drilling head include a threaded rotated journal 76 rotatably carried in the end of drilling head B and affixed to motor 70. Drilling bit 72 threads into rotating coupling 76 which is supported on bearings 78 in drilling head B. Bearings 80 are carried in a support 82 at the opposite end of the fluid motor for receiving rotor 70. In this manner, drill bit 72 and mud motor 62 are mounted eccentrically in drilling head B. In FIG. 4A, the eccentric position of drill bit 72 with respect to drilling head B can best be seen. Drilling bit 72 and mud motor 62 have a center axis denoted as 82. Drilling head B has a center noted as 84. It can be seen that the center axis of the drill bit and drill bit motor are offset relative to the center axis of the drilling head. This relationship also allows for detecting the eccentric position of the drill bit as will become more apparent. In FIG. 4A, this offset relationship of the center axis defines an eccentric position in which the drill bit overcuts relative to the outside diameter of the drilling head. By rotating the drill string and drilling head, the eccentric position of the drill bit continuously overcuts all the way around the bore 32 being formed. For example, drill bit 72 preferably has a ¼ inch overcut as illustrated at 86 so that by continuous rotation of the drilling head, a bore 32 is formed having a diameter ½ inch oversize with respect to drilling head B and drill string 28. When rotation of drill spring 28 is stopped, the drill string moves in the direction of the eccentric portion and overcuts because there is no clearance on the other side. This together with the guidance system, to be hereinafter explained, provide a simple and accurate control of the direction of the drill string. Very few moving parts internally of the drilling head are required, only rotation of the drill string and drill bit as controlled by throttles 56 and 68 are required in order to change direction of the drill string.

As can best be seen in FIG. 4B, the eccentric position of drilling bit 72 is illustrated in a 90 degree position in which the eccentric position of the drill bit would overcut to the left and direct the drilling string to the left. Center axis 82 of drill bit 72 is rotated 90 degrees in the eccentric position shown in FIG. 4B. Drill bit 72 may be any suitable drill bit such as a thermally stable diamond bit. Such a bit includes a center bore 72*b* through which the slurry which drives mud motor 62 exits to the center of the bit as shown by arrows 88. The slurry then returns through slots 72*c* formed in the drilling bit rearward through the clearance to the overcut space 86 in bore 32 and exits through the annular exit space 30 formed in end wall 18 of the drilling platform cartridge (FIG. 3). Throttles 56 and 60*a* provide control means for varying the relative speeds of the drill string motor drive and the drill bit drive motor to alter the eccentric position of the drill bit and drilling head to control the direction of the drilling head. The rotation rate of the drilling head and drill string is determined by the penetration rate which depends upon the type of earth being bored (i.e. rock, soil, etc.)

Referring to FIGS. 5–8, a guidance system according to the invention for controlling the direction of drill string 28 will now be described. In order to drill a bore from a starting point A to a destination point B, the elevations and distances between the points are provided in accordance with conventional surveying practice. This allows one to determine the grade (or slope) from points A to B, and a desired entry angle according to conventional surveying techniques. The line (horizontal direction) of the drilling head may be set with a transit. The entry angle of drilling head B is had by fixing the inclination of drilling cartridge 10 and horizontal platform 22 in concrete pit 16 in accordance with the inclination of the concrete pit as formed and poured. In the illustrated embodiment of FIG. 1, the drilling platform is set with an entry angle of zero. However, the entry angle of drilling head B may be set at any desired entry angle. In other applications, the drilling rig may be above ground so that the drilling head enters the ground at a referenced entry angle. As can best be seen in FIG. 4, a control module 90 is illustrated which includes an angle sensing means C, an angle encoder D, a distance measuring means E, and a control circuit F. In accordance with the control of the present invention it is desirable to measure the angular rate about two axis which correspond to line and grade. Angle sensing means C senses the horizontal and vertical angular position of drilling head B. Preferably, angle sensing means C includes an angular rate sensor 92 which senses the angular rate. The angular rate is then integrated to give the angular position. In the illustrated embodiment, the angular rate sensor is a single axis rectilinear momentum rate sensor which senses the angular rate about a single axis. Any suitable rectilinear rate sensor may be utilized. As illustrated, an angular rate sensor manufactured by Humphrey, Inc., of San Diego, Calif. is illustrated. It is to be understood, of course, that other angular rate sensors, such as a rate gyro may also be utilized in accordance with the invention. Single axis angular rate sensor 92 utilizes a gas pump and measures the transport time of the gas from a nozzle to a sensor wire. When the sensor body rotates the distance the gas travels and the transport time change. The changes are converted into angular rates about the sensing axis. This type of sensor is particular advantageous in the environment of an earth boring tool because it is inherently rugged having no moving parts to wear a break. As illustrated, angular rate sensor 92 is mounted within a cylindrical casing 94 of module 90 that is sealed and mounted approximately in the center of the stem of drilling head B. Angular rate sensor 92 is mounted in a first compartment with its sensing axis 96*a* perpendicular to the sheet of paper containing FIG. 5. In this position, sensor 92 measures the angular rate in the pitch or grade direction corresponding to a vertical angle. Since angular rate sensor 92 rotates with drilling head B and the drill string, it also senses the angular rate about a sensing axis 96*b* which corresponds to the angular rate in the yaw or line (horizontal) direction and the horizontal angular rate. Thus, by rotating angular rate sensor 92, a single axis angular rate sensor is converted into a two axis angular rate sensor. The angular rate sensors are integrated to provide the horizontal and vertical angular position.

Encoder means D includes a gravity referenced encoder disk 98 rotatably mounted on a shaft 100 fixed between two walls of a second compartment 102. As can best be seen in FIG. 6, encoder disk 98 includes a plurality of indicators 104, i.e. reflectors, which indicate one degree intervals from zero to three hundred and sixty degrees.

In the illustrated embodiment, angular sensor 92 and encoder disk 98 are broken down into four channels, referenced to true vertical. Channel CH1 covers the quadrant of three hundred fifteen degrees to forty-five degrees and measures the vertical angular rate in the up (+) direction. A second channel CH2 covers the quadrant of forty-five degrees to one hundred thirty-five degrees and measures a horizontal angular rate to the right (+). A channel CH3 covers a quadrant from one hundred thirty-five degrees to two hundred twenty-five degrees and covers a vertical angular rate which is inverted (−) and is in the down direction. A channel CH4 covers a quadrant of two hundred twenty-five degrees to three hundred fifteen degrees indicating a horizontal angular rate which is inverted (−) and is horizontally to the left. Encoder disk 98 rotates relative to shaft 100 but is maintained in a vertical position by a pendulum mass 106, as can best be seen in FIG. 5. As cylindrical housing 94 rotates with drilling head B, a light beam 108 emitted from a source 110 detects the reflectors, the reflection of which is received by a light receiver 112. Thus, emitter 110 and receiver 112 provide a detector means for detecting and counting the reflector intervals as they rotate relative to the gravity reference encoder disk 98. As each quadrant is entered, the signal is inverted to show opposite sign for integration. The eccentric position of drill bit axis 82 may be referenced to the corresponding indicators on disk 98, i.e. zero degrees or true vertical, so that the eccentric position of the drill bit is known at any instant. Any suitable rotary encoder may be utilized for encoder means D such as a high resolution laser rotary encoder manufactured by Canon USA, Inc. of Santa Clara, Calif.

Distance measuring means E preferably includes an accelerometer 114 also aligned along the axis "X" of drilling head B having a sensing axis 116. The accelerometer senses the rate of movement change and the accelerometer signal is integrated to provide a signal representing distance travelled from the starting point, i.e. cartridge platform 10.

Since the center axis 82 of drill bit 72 in drill bit motor 62 and the center axis of drilling head B have a predetermined relationship, as can best be seen in FIGS. 4 and 4A, and this relationship is encoded on encoder disk 98, the position of the center axis of the drill bit and drill bit motor can be known and indicated instantaneously as the drill bit and drill string rotate. By knowing the position of the center axis of the drill bit and the drill bit motor, the eccentric position in which the drill bit overcuts relative to the outside diameter of the drilling head can be determined. The eccentric position of the drill bit can be indicated on a display G at 120, as can best be seen at FIG. 7. Display G may be any suitable display such as a graphic display programmed on the screen of a microprocessor or suitable lap-top computer illustrated in the embodiment of FIG. 7.

Control circuit F includes an integrator means which preferably includes four electronic integrator circuits 122 which may be any suitable integrator circuit such as a conventional chopper stabilized operational amplifier. There is one integrator for each channel quadrant CH1–CH4. Next, there is an analog switch circuit 124 which is switched by reset pulses 126 from encoder D to stop and start the integrators as each quadrant is entered. A conventional clock 128 feeds clock timing signals to encoder D for determining time spent in each quadrant. Clock 128 may be any suitable clock circuit such as a one-kilohertz clock. The clock rate determines the rate over which the integration occurs. A second integrator means includes an electronic integrator circuit 130 which integrates the accelerometer signal for a distance measurement of the travel of drilling head B. A conventional analog to digital converter circuit 132 receives the integrated horizontal and vertical angular rate signals, and the distance travelled signal and converts them from analog to digital signals. A conventional RS232 circuit 134 receives the digital signals and feeds the digital signals to a microprocessor or conventional laptop computer H in the form of serial data along a conductor 136 as can best be seen in FIG. 7.

In operation of the guidance system, as control module 90 rotates, rotating angular sensor C and encoder D emit angular rate signals about the horizontal and vertical axis which are integrated to furnish horizontal and position angle in all four quadrants or channels CH1 through CH4. Encoder means D determines the quadrant being measured. As each quadrant is entered, the encoder sends a signal to the computer indicating which quadrant is being measured and sets the corresponding integrator. The signal is continuously monitored and integrated by an electronic integrator circuit 122 until the beginning of the next quadrant. The angular rate transducer 92 measures angular rate in reference to time and degrees per second. To determine the angular rate position, the rate change is measured against time from clock 128 and integrated with time in electronic integrator 122. To determine the angular position for each 90 degree quadrant of the bore hole, the single axis rate angular rate transducer is rotated continuously until a line (horizontal) or grade (vertical) correction is needed. The horizontal position angles is multiplied by the distance travelled during the time interval in the second and fourth quadrants and this provides the operator with a right-left position. The vertical position angle is multiplied by the distance travelled during the other pair of opposing quadrants which furnishes the operator with an up and down position or an elevation position as displayed. A prescribed path may also be established by inputting the coordinates of a reference path and comparing actual position to the reference path, rather than by computing deviations from a starting point. The guidance system is non-magnetic and is not influenced by anything but the displacement of the drilling head B. By using a low rate accelerometer, the distance travelled deviations can be accurately measured.

To begin drilling operation, drilling head B is oriented at a starting point A on platform 10 at a desired grade and line to reach a desired point B. The reference entry angle (grade) of the drilling head and the drill string is input into the computer, the line is also set by a transit and referenced. Drill bit 72 and drill string 28 continuously rotate independently at predetermined ratios during drilling. While drill bit 72 cuts an eccentric pattern, there is equal clearance cut around the drilling head resulting in a straight bore being cut due to the continuous rotation of the drill string and drilling head. Display G of the computer displays the positions of the drilling head as the drill string proceeds during drilling operations. The instantaneous position and elevation of the drilling heat are measured and computed in response to the horizontal and vertical position angle signals from angle sensor C and distance travelled signals from accelerometer E. Preferably, deviations in the line (horizontal position) and grade (vertical position) are measured from the starting point. The deviation of the drilling head to the left and to the right are instantaneously displayed on the display G along with the elevation, as can best be seen in FIG. 7. At the same time, the instantaneous position of the eccentric position of drill bit 72 is displayed at 120. In the event deviations occur in the horizontal or vertical positions of the drilling head and it becomes necessary to steer the drill string, rotation of the drill string is stopped when the eccentric portion of the drill bit is at a direction desired to steer in. With rotation of the drill string and drilling head stopped, the drill bit continuously overcuts and goes in the desired direction to steer the drill string. Once the deviations have been eliminated, the drill string commences continuous rotation with the drill bit. For example, in the illustrated embodiment of FIG. 7, the drilling head is depicted as being deviated 1.03 feet to the right, assuming the elevation is correct, the operator stops rotation of the drill string and drilling head when the eccentric position of the drill bit is at two hundred seventy degrees. This causes the drill bit to overcut to the left and the drilling string to steer to the left. When the display again reads zero deviation in the right direction, rotation of the drill string and drilling head is again initiated. In one example, the drill bit is rotated at 1000 rpm and the drill string is rotated at 10 rpm for a drive ratio of about 10 to 1. The drill string may be rotated from about 5 to 10 rpm. The rotation rates depend upon the penetration rate which depends on the type of earthen material being drilled. The drill string rotation rate can be controlled by computer H.

While a preferred embodiment of the invention has been described using specific terms, such description is for illustrative purposes only, and it is to be understood that changes and variations may be made without departing from the spirit or scope of the following claims.

What is claimed is:

1. A directional drilling system of the type which includes a drill string having a plurality of drill stems joined together for drilling a bore through the earth in a prescribed direction comprising:

a drilling platform disposed at a starting point;

a frame carried by said platform;

a carriage carried by said frame;

a drill string drive motor carried by said carriage for coupling with and rotating said drill string;

carriage advance means for moving said carriage longitudinally along said platform as said drill string drive motor rotates the drill string;

a drilling head carried at an end of said drill string;

a drill bit motor carried by said drilling head;

a drill bit carried by said drill bit motor;

eccentric mounting means for mounting said drill bit eccentrically in said drilling head to define an eccentric position in which said drill bit overcuts relative to a diameter of said drilling head;

indicator means for indicating the rotational angular position of said eccentric position of said drill bit relative to said drill string;

position measuring means for measuring the position of said drilling head and determining deviations in the position of said drilling head with reference to a desired drill string path;

control means for varying the relative speeds of said drill string drive motor and said drill bit motor to control the eccentric position of said drill bit to overcut in a desired direction and control the direction of said drilling head and drill string in response to said drill bit eccentric position to eliminate said deviations in said drilling head position.

2. The apparatus of claim 1 wherein said position measuring means includes an angle sensor means for measuring first and second position angles of said drilling head and generating first and second angle signals corresponding to the horizontal and vertical position angles of said drilling head.

3. The apparatus of claim 2 wherein said angle sensor means includes an angular rate sensor carried by said drill string for measuring changes about a first axis per unit time, and said angular rate sensor is rotatably carried by said drilling head to measure changes in direction about a second axis per unit time for generating said first and second angular rate signals corresponding to changes directions per unit time about said first and second axes.

4. The apparatus of claim 3 including a encoder means for determining the rotational position and timing of said angular rate sensor and said drill string as they rotate together.

5. The apparatus of claim 4 including electronic integrator means for integrating said first and second angular rates according to said instantaneous rotational positions and timing from said encoder means and producing said horizontal and vertical position angles.

6. The apparatus of claim 5 wherein said position measuring means includes a distance measuring means for measuring the distance said drilling head has travelled from said starting point; and computes the horizontal and vertical position of said drilling head corresponding to said distance and said horizontal and vertical position angles.

7. The apparatus of claim 4 wherein said encoder means includes a gravity referenced encoder disk with a plurality of encoded position indicators around the periphery of said encoder disk, and detector means for converting said position indicators into said rotational position and timing of said angular rate sensor and drilling head.

8. The apparatus of claim 1 wherein said platform includes a platform cartridge which is installed in a ground pit, and concrete surrounds said platform cartridge in the pit.

9. The apparatus of claim 8 including an evacuation device for removing slurry with cuttings from said pit.

10. The apparatus of claim 1 wherein said platform is disposed in an earthen pit; and said platform includes at least one end wall, a drill string opening in said end wall receiving the drill string, and annular slurry exit space in said drill string opening between said drill string and end wall for returning slurry with cuttings to said pit for evacuation.

11. The apparatus of claim 1 wherein said drill string drive motor is carried by said carriage for rotating said drill string and including a control for controlling the rotational speed of said drill string drive motor.

12. The apparatus of claim 11 including coupling means for coupling a drill stem of said drill string to the drill string drive motor.

13. The apparatus of claim 1 wherein said drill bit motor includes a fluid turbine motor.

14. The apparatus of claim 1 wherein drill string and drill drive motors are driven in a ratio of about 10:1 for drilling in a constant direction.

15. The apparatus of claim 1 including a visual display for visually displaying a representation of the actual horizontal and vertical position of said drilling head relative to said desired drilling string path.

16. A directional drilling system of the type which includes a drill string having a plurality of drill stems joined together for drilling a bore through the earth in a prescribed direction comprising:

a drilling platform having two spaced apart end walls carried by said platform;

a frame carried by said platform;

a carriage carried by said frame;

a drill string drive motor carried by said carriage for rotating said drill string;

coupling mans for coupling one of said drill stems to said drill string drive motor; and carriage advance means for moving said carriage longitudinally along said frame and platform as said drill string drive motor rotates the drill string.

17. The apparatus of claim 16 wherein said frame extends between two end walls of platform.

18. The apparatus of claim 16 wherein a first end wall includes a drill string opening in said end wall receiving the drill string.

19. The apparatus of claim 18 wherein said platform is disposed in an earthen pit, and including an annular slurry exit space in said drill string opening defined between said drill string and said end wall for returning slurry with cuttings to said pit for evacuation.

20. The apparatus of claim 16 including guide elements carried by the platform along which a carriage moves.

21. The apparatus of claim 20 wherein said guide elements include guide ways providing a track for controlling the line of motion of said carriage.

22. The apparatus of claim 16 including elongated guide bars extending between the end walls of the platform over which the carriage slides.

23. The apparatus of claim 16 wherein said platform is disposed in an earthen pit and including a control for the rotational speed of said drill string drive motor disposed outside of said pit and above ground.

24. The apparatus of claim 23 wherein said drill string drive motor includes a hydraulic motor carried by said carriage, and said control includes a throttle for throttling fluid to said motor.

25. The apparatus of claim 16 wherein said carriage advance means includes:

a carriage drive motor; and a screw drive connected to said carriage and driven by carriage drive motor which advances said carriage longitudinally.

26. The apparatus of claim 25 wherein said carriage drive motor is carried by an end wall of said drilling platform and rotates said screw drive.

27. The apparatus of claim 16 including elongated screw rods included in said frame driven by said carriage drive motor, and said carriage threadably receives said screw rods to be advanced longitudinally.

28. The apparatus of claim 16 including a concrete pit formed in the earth at a prescribed orientation and inclination corresponding to a desired entry angle of said drill string; and wherein said platform includes a platform cartridge which is installed in said concrete pit.

29. The apparatus of claim 16 wherein said drilling platform includes a drilling platform cartridge inserted in a ground pit.

30. The apparatus of claim 29 including an evacuation device for removing slurry with cuttings from said pit.

31. The apparatus of claim 29 including at least one end wall carried by the platform, a drill string opening in said end wall receiving the drill string, and annular slurry exit space said drill string opening between said drill string and end wall for returning slurry with cuttings to said pit for evacuation.

32. A directional drilling system of the type which includes a drill string having a plurality of drill stems joined together for drilling a bore through the earth in a prescribed direction comprising:

a drilling head carried at an end of said drill string;

a drive motor for causing said drilling head to be rotated;

a drill bit motor carried by said drilling head;

eccentric mounting means for mounting said drill bit eccentrically in said drilling head to define an eccentric position in which said drill bit overcuts relative to a diameter of said drilling head;

control means for varying the relative rotational speeds of said drill string drive motor and said drill bit motor to alter the eccentric position of said drill bit to overcut in a desired direction and control the direction of said drilling head and drill string.

33. The apparatus of claim 32 wherein said drive motor includes a drill string drive motor which drives said drilling head and said drill string in rotation, and said drill bit and drill bit drive motor-are eccentrically mounted in axial alignment.

34. The apparatus of claim 32 wherein said control means stops rotation of said drilling head when said drill bit is at a desired eccentric position in order to steer said drill string in a direction corresponding to said eccentric position.

35. The apparatus of claim 34 including position measuring means for determining the position of said drilling head along a drill path.

36. The apparatus of claim 35 including indicator means for determining said eccentric position of said drill bit.

37. The apparatus of claim 34 wherein drill string and drill bit motors are driven in a ratio of about 10:1 in order to maintain said drill string in a generally constant direction.

38. The apparatus of claim 32 wherein said drill bit motor includes a fluid turbine motor.

39. The apparatus of claim 38 wherein said control means for controlling the rotational speed of said fluid turbine motor includes a throttle for controlling the flow rate of fluid to said drill bit motor.

40. The apparatus of claim 38 wherein said control means includes throttle means for controlling the rotational speeds of said drill bit motor and said drill string motor.

41. Directional drilling apparatus of the type which includes a drill string having a plurality of drill stems joined together for drilling a bore through the earth in a prescribed direction, a drilling head disposed at an end of said drill string carrying a rotating drill bit for cutting said bore, and a guidance system for controlling the direction of the drill string, wherein said apparatus comprises:

means for rotating said drilling head;

eccentric mounting means for mounting said drill bit eccentrically in said drilling head to define an eccentric position in which said drill bit overcuts said bore relative to a diameter of said drilling head;

angle sensor means for measuring a first and second position angle of said drilling head and generating first and second angle signals corresponding to the first and second position angles;

distance measuring means for measuring the distance travelled by drill head from a starting point and generating a corresponding distance signal;

computer means for processing said first and second angle signals, and distance signal to compute the horizontal and vertical position of said drilling head and deviations of said drilling head from horizontal and vertical positions along a desired drill path; and control means for varying the relative rotational speeds of said drilling head and drill bit to control the eccentric position of said drill bit and steer said drilling head and drill string in a desired direction to eliminate said deviations and steer said drill string along said desired drill path.

42. The apparatus of claim 41 wherein said angle sensor means includes an angular rate sensor carried by said drill string for measuring angular changes about a first axis per unit time, and said angular rate sensor is rotatably carried with said drill string to measure changes in, direction about a second axis per unit time for generating said first and second angular rate signals corresponding to changes directions per unit time about said first and second axes.

43. The apparatus of claim 42 including encoder means for determining the rotational position and timing of said angular rate sensor, and said eccentric drill bit.

44. The apparatus of claim 43 including electronic integrator means for integrating said first and second angular rates according to said rotational positions and timing signals from said encoder means and generating horizontal and vertical angular position angle signals.

45. The apparatus of claim 44 wherein said encoder means includes a gravity referenced encoder disk with a plurality of encoded position indicators around the periphery of said encoder disk arranged in four quadrants, and detector means for converting said position indicators into quadrant position and timing signals of said rotating, angular rate sensor.

46. The apparatus of claim 45 wherein said encoder means is encoded to indicate the rotational position of a center axis of said drill bit for generating a drill bit position signal; and said detector means rotates with said drilling head while said encoder disk remains vertical in reference to gravity.

47. The device of claim 46 including a pendulum mass to keep said encoder disk vertical, and said position indicators include degree intervals referenced to gravity.

48. The apparatus of claim 45 wherein said detector means includes an energy beam emitter and receiver which rotate with said drilling head for detecting encoded reflectors on said gravity referenced disk to determine where the position and quadrant of said sensor.

49. The apparatus of claim 45 wherein said four quadrants include right and left horizontal quadrants, and up and down vertical quadrants; and said integrator means integrates the angular rates of said drilling head which corresponds to rotation of angular rate sensor through said four quadrants for generating said horizontal and vertical position angle signals.

50. The apparatus of claim 49 wherein said encoder means generates quadrant position signals which sets said integrator means upon entering each of said quadrants for integration during rotation through each of said quadrants.

51. The apparatus of claim 50 wherein said integrator means generates a right position angle signal and an inverted left position angle signal in response to integration through two of said quadrants which are one hundred and eighty degrees opposed, and generates an up position angle and an inverted down position angle in response to integration through two of said quadrants which are one hundred and eighty degrees opposed from one another.

52. The apparatus of claim 41 wherein said computer means computes a left and right horizontal position deviation signal, and an elevation signal.

53. The apparatus of claim 41 including encoder means for determining the rotational position of said eccentric position of said drill bit.

54. The apparatus of claim 53 including a visual display of said horizontal and vertical positions along said drill path, and said drill bit position.

55. A directional drilling system having a drill string with a plurality of drill stems joined together for drilling a bore through the earth in a desired direction comprising:

drive means for rotating at least a drilling head carried at an end of said drill string having a central axis;

a drill bit carried by said drilling head having a center axis displaced from the center axis of said drilling head so that said drill bit is carried at an eccentric position by said drilling head in which said drill bit overcuts said bore relative to an outside diameter of said drilling head;

means for rotating said drill bit independently of said drilling head;

means for indicating the eccentric position of said drill bit in reference to said drilling head;

position measuring means for determining the position of said drilling head relative to a desired drill string direction and path, and determining deviations of said drilling head from said path; and control means for controlling the relative rotational speeds of said drilling head and drill bit relative to each other to control the eccentric position of said drill bit to overcut said bore in a desired direction and steer said drill string in that direction to eliminate said deviations and steer said drill string along said desired drill path.

56. The apparatus of claim 55 wherein said drive means includes a drill string drive means for rotating said drill string and said drilling head.

57. The apparatus of claim 55 wherein said means for rotating said drill bit includes a fluid motor mounted eccentrically in said drilling head coaxial with said center axis of said drill bit.

58. The apparatus of claim 55 wherein said position measuring means includes an angular rate sensor means which rotates with said drilling head for measuring horizontal and vertical angular rates.

59. The apparatus of claim 58 wherein said position measuring means includes means for computing horizontal and vertical position angles from said horizontal and vertical angular rates, and means for measuring the distance travelled by said drilling head to compute horizontal and vertical position of said drilling head.

60. Directional drilling apparatus of the type which includes a drill string having a plurality of drill stems joined together for drilling a bore through the earth in a prescribed direction, a drilling head carrying a rotating drill bit for cutting said bore; and a guidance system for controlling the direction of the drill string; wherein said apparatus comprises:

an angle sensor means carried by said drilling head for measuring horizontal and vertical position angles of said drilling head and generating first and second angle signals corresponding to said horizontal and vertical position angles of said drilling head;

distance measuring means for measuring the distance said drilling head has travelled and generating a distance signal;

computer means for processing said first and second angle signals and said distance signals for computing deviations of said drilling head and drill string from a desired drill path;

said angle sensor means including an angular rate sensor means for measuring changes about two orthogonal axes, means for mounting said angular rate sensor for continuous rotation with said drilling head, and said rotating angular rate sensor means senses changes about said two axes for generating said horizontal and vertical angular rate signals corresponding to changes in direction per unit time about said first and second axes; and encoder means for determining the rotational position and timing of said angular rate sensor and said drilling head while said angular rate sensor and drilling head are rotating together.

61. The apparatus of claim 60 wherein said drilling head rotates, and said angular rate sensor means includes a single axis angular rate sensor for measuring changes about a first axis per unit time, and said angular rate sensor is rotatably carried with said drilling head to measure changes in direction about a second axis per unit time for generating said horizontal and vertical angular rate signals corresponding to changes in direction per unit time about said first and second axes.

62. The apparatus of claim 60 including electronic integrator means for integrating said first and second angular rates according to said rotational positions and timing from said encoder means and producing said horizontal and vertical position angle signals.

63. The apparatus of claim 62 wherein said encoder means includes a gravity referenced encoder disk with a plurality of encoded position indicators around the periphery of said encoder disk arranged in four quadrants, and detector means for converting said position indicators into quadrant position and timing signals of said rotating angular rate sensor.

64. The device of claim 63 including a pendulum mass to keep said encoder disk vertical, and said position indicators include degree intervals referenced to gravity.

65. The apparatus of claim 63 wherein said detector means includes an energy beam emitter and receiver which rotate with said drilling head for detecting encoded reflectors on said gravity referenced disk to determine where the position and quadrant of said sensor.

66. The apparatus of claim 63 wherein said four quadrants include right and left horizontal quadrants, and up and down vertical quadrants; and said integrator means integrates the angular rates of said drilling head which corresponds to rotation of angular rate sensor through said four quadrants for generating said horizontal and vertical position angle signals.

67. The apparatus of claim 66 wherein said encoder means generates quadrant position signals which sets said integrator means upon entering each of said quadrants for integration during rotation through, each of said quadrants.

68. The apparatus of claim 67 wherein said integrator means generates a right position angle signal and an inverted left position angle signal in response to integration through two of said quadrants which are one hundred and eighty degrees opposed, and generates an up position angle and an inverted down position angle in response to integration through two of said quadrants which are one hundred and eighty degrees opposed from one another.

69. The apparatus of claim 60 wherein said computer means computes a left and right horizontal position deviation signal, and an elevation signal.

70. The apparatus of claim 69 including a visual display of said horizontal and vertical positions along said drill path, and said drill bit position.

71. The apparatus of claim 69 wherein said distance measuring means measures the distance said drilling head has travelled from a starting point; and said computer means computes the horizontal and vertical position of said drilling head corresponding to said horizontal and vertical position angles as deviations of said drilling head from a path set at said starting point.

72. The apparatus of claim 60 including:

means for rotating at least said drilling head carried at an end of said drill string having a central axis;

said drill bit having a center axis displaced from the center axis of said drilling head so that said drill bit is carried at an eccentric position by said drilling head in which said drill bit overcuts said bore relative to an outside diameter of said drilling head;

means for rotating said drill bit independently of said drilling head;

means for indicating the eccentric position of said drill bit in reference to said drilling head; and control means for controlling the relative rotational speeds of said drilling head and drill bit relative to each other to control the eccentric position of said drill bit to overcut said bore in a desired direction and steer said drill string in that direction to steer said drill string to eliminate said deviations of said drilling head from said desired drill path.

73. A method of guiding a directional drill string of the type which has a plurality of drill stems joined together, a drilling head carried at the end of said drill stem having a central axis, a drill bit carried by said drilling head for cutting a bore in the earth; wherein said method comprises:

mounting an angular rate sensor means in said drilling head for measuring angular rate about a first and second sensing axis per unit of time;

rotating said single axis angular rate sensor means continuously with said drilling head while cutting said bore about said central axis of said drilling head to measure angular rate about said first and a second sensing axes which intersect said center axis of said drilling head and generating first and second angular rate signals corresponding to horizontal and vertical angular rates;

determining the rotational position of said angular rate sensor means as it rotates with said drilling head through four quadrants and generating sensor quadrant position and timing signals corresponding to the quadrant position and timing of said angular rate sensor through said quadrant as said angular rate sensor rotates with said drilling head;

integrating said first and second angular rate signals and said sensor quadrant position and timing signals to generate first and second position angle signals corresponding to the horizontal position angle and vertical position angles of said drilling head;

determining the distance said drilling head has travelled from a starting point and instantaneously generating a distance travelled signal;

processing said horizontal and vertical position angles with said distance signal to compute horizontal and vertical positions;

comparing said horizontal and vertical positions to a desired drill path and calculating deviations from said path; and steering said drilling head to eliminate said deviations.

74. The method of claim 73 comprising measuring the distance that said drilling head has travelled by disposing an accelerometer along said central axis of said drilling head and generating a distance signal in reference to movement of said drilling head, and integrating said distance signal to provide distance travelled from a starting point.

75. The method of claim 73 comprising measuring the rotational quadrant position of said angular rate sensor by rotatably mounting a gravity referenced disk on a rotational axis concentric with the central axis of said drilling head; and detecting position indicators on said encoder disk with a detector which rotates with said drilling head.

76. A method for steering a directional drilling device of the type which includes a drill string having a drilling head for cutting a bore through the earth in a prescribed direction comprising:

rotating a drilling head carried at an end of said drill string;

mounting a rotating drill bit eccentrically in said drilling head so that a center axis of said drill bit and drilling head have a known relationship; and said drill bit has an eccentric position in which said drill bit overcuts said bore relative to a diameter of said drilling head; and controlling the relative rotational speeds of said drilling head and drill bit to alter the eccentric position of said drill bit to overcut said bore in a desired direction and control the direction of said drilling head and drill string.

77. The method of claim 76 including rotating drilling head and drill bit at a ratio of about 10:1, and stopping rotation of said drilling head to overcut said bore and change direction.

78. A method of drilling a bore through the earth in a desired direction using a directional drilling device having a drill string with a drilling head carried at an outer end comprising:

excavating a pit in the earth at a starting point of said drill string;

placing a form in said earth pit at a prescribed inclination corresponding to a desired reference entry angle of said drilling string and drilling head;

pouring concrete in said earth pit between said form and the earth to form a concrete pit having a pit opening corresponding to said form, and thereafter removing said form;

placing a drilling platform having a shape generally conforming to the shape of said form in said pit opening of said concrete pit so that said platform is set in said concrete pit at said reference entry angle; and assembling said drilling head and drill string on said platform so that said drilling head is oriented in the direction of said reference entry angle.

79. The method of claim 78 including placing a drilling platform in said concrete pit having at least two spaced end walls, and carrying said drill string and drilling head on a carriage that moves between said end walls.

80. The method of claim 79 including simultaneously rotating said drill string and moving said carriage between said end walls.

81. The method of claim 80 including controlling the operation of said drilling device above ground outside of said concrete pit.

* * * * *